US005242696A

United States Patent [19]

McDevitt

[11] Patent Number: 5,242,696

[45] Date of Patent: Sep. 7, 1993

[54] FOOD PACKAGE WITH RESILIENTLY BIASED LID

[75] Inventor: John F. McDevitt, Evanston, Ill.

[73] Assignee: Kraft General Foods, Inc., Northfield, Ill.

[21] Appl. No.: 699,809

[22] Filed: May 14, 1991

[51] Int. Cl.[5] ..... B65D 43/16

[52] U.S. Cl. ..... 426/106; 426/129; 426/130; 220/339; 220/264; 229/2.5 R

[58] Field of Search ..... 220/339, 264; 229/2.5 R, 2.5 EC; 426/129, 130

[56] References Cited

U.S. PATENT DOCUMENTS

| | | | |
|---|---|---|---|
| 2,185,604 | 1/1940 | Moore | 229/43 |
| 2,935,188 | 5/1960 | Thomas | 206/42 |
| 3,082,903 | 3/1963 | Stevens et al. | 220/30 |
| 3,145,895 | 8/1964 | Reifers | 229/2.5 EC |
| 3,351,270 | 11/1967 | Hohnjec | 220/339 |
| 3,423,004 | 1/1969 | Christensson | 229/14 |
| 3,551,940 | 1/1971 | Edison | 220/339 |
| 3,556,337 | 1/1971 | Harmon | 220/339 |
| 3,620,411 | 11/1971 | Rump | 229/2.5 |
| 3,628,215 | 12/1971 | Everburg | 220/339 |
| 3,651,983 | 3/1972 | Haugen | 220/315 |
| 3,710,975 | 1/1973 | Jansen | 220/31 S |
| 3,893,566 | 7/1975 | Ross | 206/498 |
| 3,904,074 | 9/1975 | Hoffman et al. | 220/339 |
| 3,955,006 | 5/1976 | Sokolsky et al. | 426/392 |
| 4,098,430 | 7/1978 | Mattheis et al. | 220/339 |
| 4,170,315 | 10/1979 | Dubach et al. | 220/281 |
| 4,202,464 | 5/1980 | Mohs et al. | 220/239 |
| 4,226,358 | 10/1980 | Ottow | 229/44 R |
| 4,241,863 | 12/1980 | Faller | 229/27 |
| 4,243,140 | 1/1981 | Thrun | 206/380 |
| 4,244,470 | 1/1981 | Burnham | 229/2.5 R |
| 4,358,025 | 11/1982 | Urion | 220/258 |
| 4,401,229 | 8/1983 | Bell et al. | 220/259 |
| 4,492,331 | 1/1985 | Bixler et al. | 229/2.5 EC |
| 4,498,588 | 2/1985 | Scott | 206/526 |
| 4,498,589 | 2/1985 | Scott et al. | 206/526 |
| 4,553,692 | 11/1985 | Padovani | 229/2.5 EC |
| 4,579,246 | 4/1986 | Swearingen et al. | 220/258 |
| 4,583,679 | 4/1986 | Johnson | 229/43 |
| 4,753,351 | 6/1988 | Guillin | 229/2.5 R |
| 4,768,703 | 9/1988 | Sosler et al. | 229/123.1 |
| 4,811,846 | 3/1989 | Bottega | 206/542 |
| 4,892,220 | 1/1990 | Foos | 229/2.5 R |
| 4,901,884 | 2/1990 | Kallenbach | 229/2.5 R |
| 4,962,854 | 10/1990 | Ricci | 220/339 |
| 4,966,284 | 10/1990 | Sykes et al. | 206/387 |
| 4,971,220 | 11/1990 | Kaufman et al. | 220/335 |
| 5,012,928 | 5/1991 | Proffitt et al. | 206/508 |
| 5,036,997 | 8/1991 | May et al. | 220/335 |

FOREIGN PATENT DOCUMENTS

| | | | |
|---|---|---|---|
| 0383677 | 8/1990 | European Pat. Off. | 220/339 |
| 2255800 | 8/1975 | France | 220/339 |

*Primary Examiner*—Steven Weinstein

*Attorney, Agent, or Firm*—Fitch, Even, Tabin & Flannery

[57] ABSTRACT

A polymeric container for a sliced food product comprising a bottom wall, a peripheral wall structure extending upward therefrom, a lid, and an integral hinge connecting the lid to the peripheral wall structure, wherein the hinge biases the lid toward an open position. Locks are provided to maintain the lid in closed position. The locks are configured that may that may be released by application of inward pressure to the front wall of the container, without application of external manual force to the lid.

4 Claims, 2 Drawing Sheets

FOOD PACKAGE WITH RESILIENTLY BIASED LID

BACKGROUND OF THE INVENTION

The invention relates generally to packaging, and more particularly to a reclosable package for food products.

In packaging of certain food items, it has been found desirable to employ reclosable polymeric box-type containers. Containers of this type have been used in the past for retail packaging of sliced cheese, and for various other food items. Such containers may be formed by vacuum molding or thermoforming operations.

One particular container of this type which has been used in the past for sliced cheese comprises a generally parallelepiped bottom portion and a lid joined thereto by a flexible hinge at the rear of the container. The bottom portion has substantially vertical walls which flare outward at their upper ends to define a continuous rim about the upper periphery of the bottom portion. The lid has a depending lip with inwardly protruding bosses at its front corners which engage a portion of the rim to lock the lid in closed position. The container is dimensioned only slightly larger than the product, with vertical flutes or channels in its back wall to accommodate a user's fingers. To open the lid, the user must apply upward pressure to one of the front corners of the lid to disengage one of the bosses from the rim by deflection of the boss and/or the rim, then apply further upward pressure to the opposite front corner to disengage the boss at that corner from the rim. The user must then manually pivot the lid upward to an open position to obtain access to the product.

Another container of this type has a lid with a large central recess which complementarily fits the mouth of the lower portion of the container as a plug. Means are provided at the forward corners to facilitate pulling apart of the adjacent edges of the lid and the lower portion of the container.

SUMMARY OF THE INVENTION

In accordance with the invention, there is provided a polymeric container comprising a bottom wall, a peripheral wall structure extending upward from the bottom wall, a lid, and a hinge or joint structure pivotally connecting the lid to the peripheral wall structure, wherein the hinge includes means for resiliently biasing the lid toward an open position. The hinge is capable of storing sufficient potential energy to drive the lid from a closed position to an open position through an angle greater than 90° while also constraining the back edge of the lid against upward displacement.

A lock structure is provided to retain the lid in closed position. Means are provided to enable the lid to be released by application of manual inward pressure to a particular area of the peripheral wall structure, without requiring application of external manual force to the lid.

As the lid is pivoted from open position to closed position, the initial motion of the lid causes a first mode of flexure of the hinge, in which segments pivot relative to one another about lines of weakness. Subsequent motion toward the closed position effects flexure in a second mode in which relatively thick, stiff portions of the container are flexed.

Additional features of the invention are set forth below and shown in the accompanying drawings.

DETAILED DESCRIPTION OF THE PREFERRED EMBODIMENT

Figure 1:
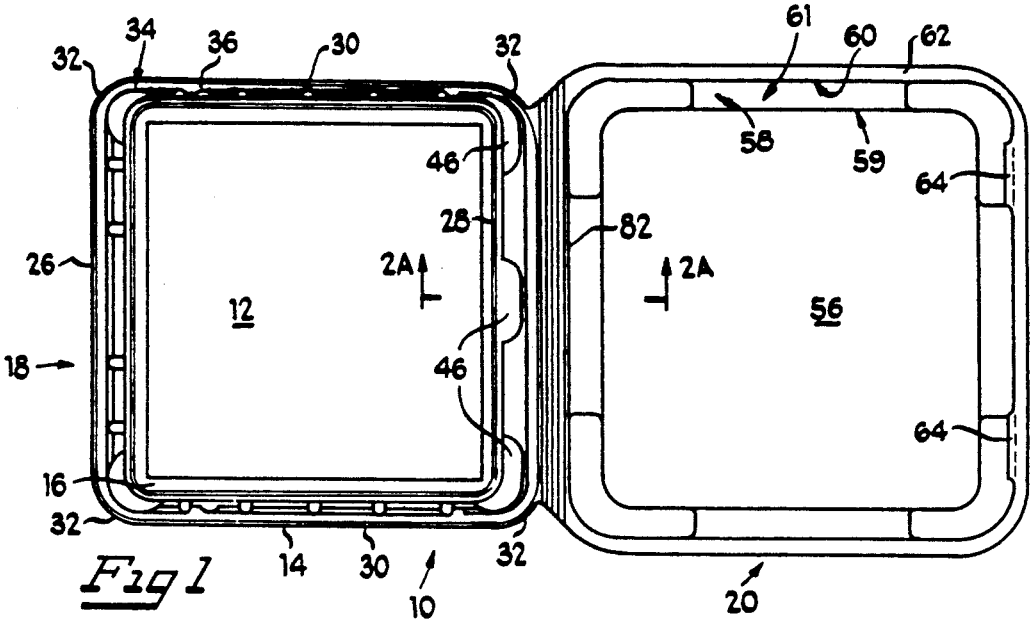
FIG. 1 is a plan view of a container in accordance with the invention, shown in an open configuration.

The invention is preferably embodied in a one-piece food container 10 integrally formed of a polymeric material and in the combination of the container 10 and a food product 12 contained therein. The container 10 has a lower portion 14 comprising a bottom wall 16 with a peripheral wall structure 18 extending upward therefrom, and a lid 20 which is connected to the bottom portion 14 by a flexible joint or hinge 22. The shape of the container 10 conforms generally to the shape of the food item 12 contained therein. The illustrated container 10 and food item 12 are generally square as viewed in plan. In other embodiments of the invention, the container may have a generally rectangular, circular or other plan, to conform to the shape of a different food item.

The illustrated food item 12 comprises a stack of individually-wrapped horizontally-oriented slices of cheese. Such slices are intended to be usable one-by-one, on an individual basis, and accordingly the container 10 may be subjected to opening and closing several times over the period of use of the food item. It will be appreciated that the container 10 may be useful in combination with various other food items, such as sliced luncheon meats, or with other items of various kinds where reclosability of packaging is desired.

Figure 3:
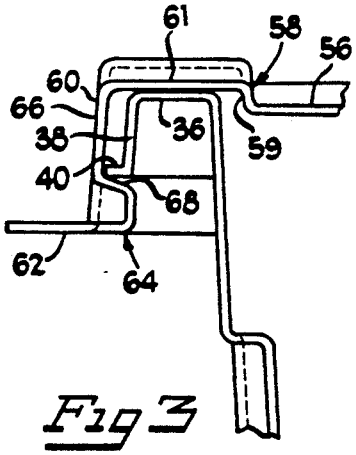
FIG. 3 is an enlarged fragmentary detail view of a lock on the container of FIG. 1.

Referring in detail to the lower portion 14 of the container, the peripheral wall structure 18 comprises a front wall 26, a rear wall 28, and a pair of side walls 30 which are joined to one another at rounded corners 32. The wall structure 18 flares outward and downward about its upper edge to define a rim 34 having a generally horizontal upper surface 36 and a depending lip 38. Along the sides and front of the container, the lip 38 slopes downward to an outwardly-extending edge portion 40 as best seen in FIG. 3. The portion of the lip 38 extending along the rear wall 28 of the container extends downward beyond the other portions and forms a part of the hinge 22 as described below.

The walls 26, 28 and 30 slope slightly outward from the bottom so that the container may be nested with other like containers. To this end, upper and lower steps 42 and 44 are provided at the corners 32 to limit the depth of penetration of the container into an adjacent container when nested, with the exterior surfaces of the lower steps 44 on each container resting on the interior surfaces of the upper steps 42 of the container below.

The outward inclination of the walls serves to enable the food item 12 to be maintained generally centrally of the container by engagement with lower portions of the walls, while sufficient spacing is provided between the food product and the upper portion of the front wall of the container to permit inward deflection of the front wall of the container for purposes described hereinbelow. Three substantially vertical flutes 46 are provided in the back wall to accommodate the fingers of the user, which facilitates dispensing of product and facilities separation of slices from one another. Additional outwardly-projecting vertical ribs 48 and horizontal ribs 50, 52, 54 may be provided to increase stiffness and rigidity of the container and to enhance the appearance of the container.

The lid 20 is configured to fit over the rim 34, and to this end comprises a generally flat central portion 56 surrounded by a peripheral channel 58 which opens downwardly to overlie the rim 34. The channel has an upper wall 61, an inner wall 59, and an outer wall 60. A substantially horizontal peripheral flange 62 extends outward at the bottom of the outer wall 60 along the sides and front of the lid. At the rear of the lid, the peripheral flange 62 conforms to the rounded corners of the lid, and forms part of the hinge structure 22 described below.

To maintain the lid in closed position, a lock mechanism is provided to lock the front wall 26 of the lid to the peripheral wall structure 18. The lock mechanism comprises a pair of bosses 64 projecting inwardly from the front wall 66 of the lid to engage portions of the edge 40 of the rim 34 of the lower portion 14 adjacent the front corners thereof. Each boss 64 projects inwardly about 0.03 in. relative to the inner surface of the front wall 66 of the lid. Each of the bosses 64 has a width of about 0.625 in., and has a upper surface 68 which is sloped downward from the front wall at about 20° to the horizontal, and which engages the edge 40 of the rim 34 when the lid is locked in closed position.

Figure 2:
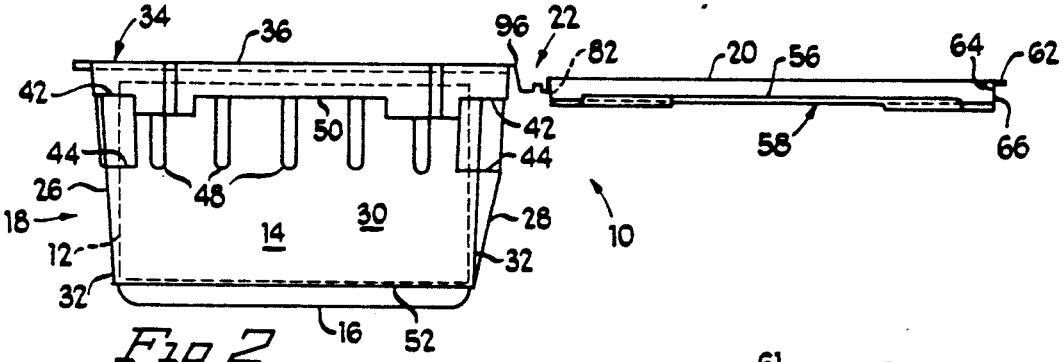
FIG. 2 is a side elevational view of the container of FIG. 1.
Figure 2A:
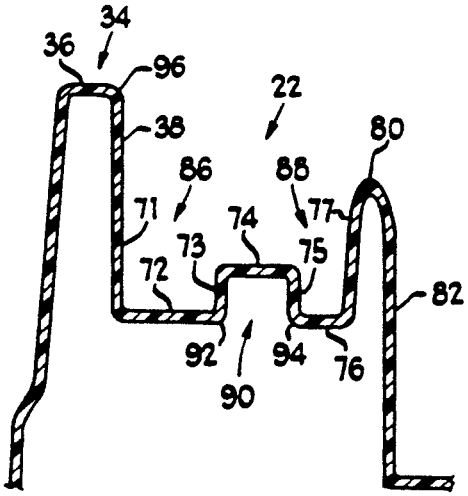
FIG. 2A is an enlarged fragmentary sectional detail view of the hinge of the container of FIG. 1.

The flexible hinge 22, in its undeformed configuration corresponding to the open position of the lid shown in FIGS. 1 and 2, is illustrated in section in FIG. 2A. The hinge 22 comprises a series of integrally joined generally rectangular segments which are described below in order proceeding from the lower portion 14 of the container to the lid 20. The first segment 71 comprises the portion of the downwardly-depending lip 38 which extends along the rear wall 28. The second segment 72 extends generally horizontally rearward from the lower end of the first segment 71. The third, fourth and fifth segments 73, 74 and 74 respectively, extend upward, rearward and downward respectively, with the third and fifth segments 73 and 75 being of approximately equal length. The sixth segment 76 extends rearward, and has a horizontal dimension less than that of the second segment 72. The seventh segment 77 extends upward to a fold line 80 at which it intersects the vertical rear wall 82 of the lid to define an inverted U-shaped configuration, except at the ends of the hinge, corresponding to the rear corners of the lid, where the seventh segment 77 and the flange 62 of the lid define an angle of about 90° about the fold line 80. The fold line 80 lies in the plane of the peripheral flange 62. The seventh segment 77 has a vertical dimension less than that of the first segment 71, and has its lower edge at approximately the same elevation as the lower edge of the first segment 71. Each of the segments 71-77 intersects its adjacent segments(s) at an angle of about 90°.

Still referring to the hinge 22 in the open position, the first three segments 71, 72 and 73 define a first upwardly opening channel 86, and the fifth, sixth and seventh segments 75, 76 and 77 define a second upwardly opening channel 88, with the third, fourth and fifth segments 73, 74 and 75 defining a downwardly opening channel 90 which is disposed between the first two, sharing a common side wall with each.

When the lid is moved from the open position to the closed position, the initial pivotal motion of the lid causes flexure of the hinge in a first mode, which principally comprises flexure at the lines of intersection between the second and third segments 72 and 73, and between the fifth and sixth segments 75 and 76. These lines of intersection appear as points 92 and 94 respectively in FIG. 2A, and will be referred to herein for convenience of description as "action points." The flexure at action point 94 enables the second channel 88 to close upon itself, such that the seventh segment 77 abuts the intersection between the fourth and fifth segments 74 and 75. Flexure occurs simultaneously at action point 92, so that segments 71 and 73 also move toward one another, and the upper portion of segment 77, and particularly the fold line 80 at the upper edge of segment 77, comes into abutting contact with segment 71. At this point, the torque required to advance the lid further toward the closed position increases significantly. Further displacement of the lid toward the closed position affects a second mode of flexure. In the second mode of flexure, the first segment 71 flexes about fold line 96 away from the back wall 28 of the container, and the seventh segment 77 pivots about fold line 80 away from the back wall of the lid 20. Fold lines 96 and 80 are relatively stiff as compared with the lines corresponding to the action points 92 and 94. Thus, the flexure of these fold lines requires greater torque, and concomitantly results in greater storage of potential energy, than flexure at the action points 92 and 94. The upper rim surface 36 and back wall 82 of the lid, which are also relatively stiff, may also be strained during the second mode of flexure.

Figure 4:
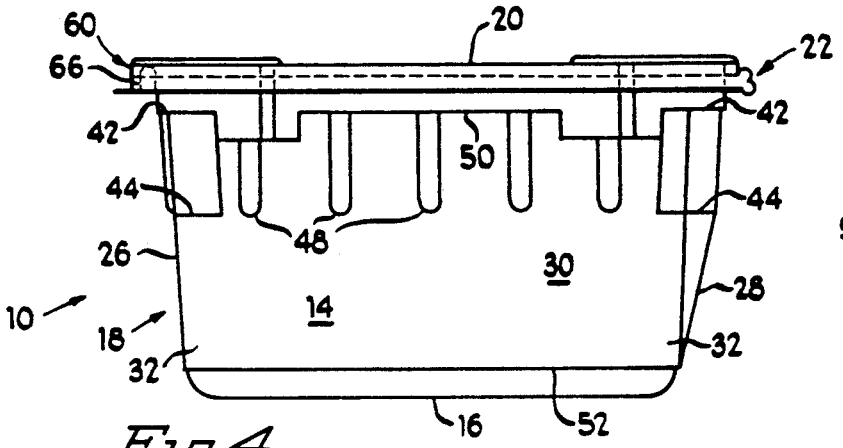
FIG. 4 is a side elevational view of the container of FIG. 1, with the lid shown in closed position.
Figure 4A:
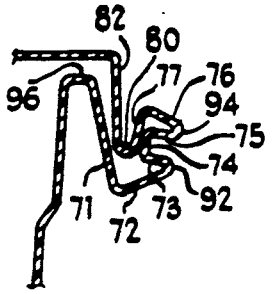
FIG. 4A is an enlarged fragmentary sectional detail view of the hinge of the container of FIG. 4, in closed position.
Figure 5:
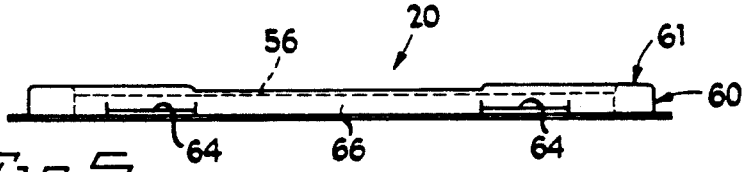
FIG. 5 is a front elevational view of the lid of the container of FIG. 1.
Figure 6:
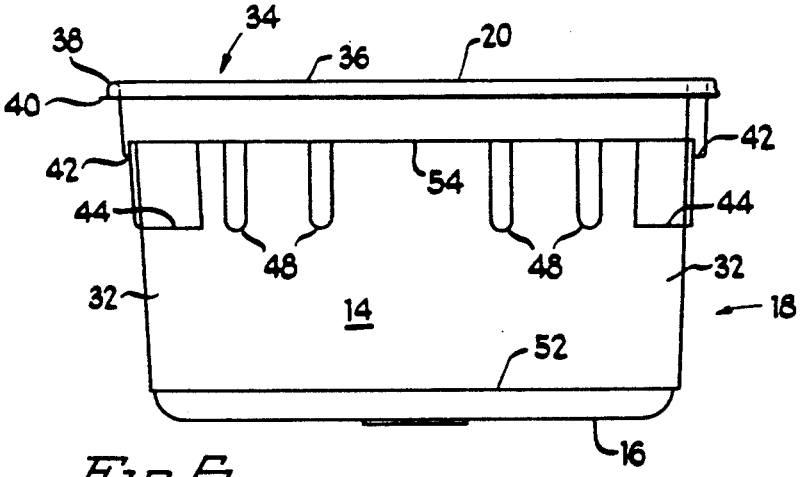
FIG. 6 is a front elevational view of the lower portion of the container of FIG. 1.

As the lid continues to pivot toward the closed position, fold line 80 slides downward along the first segment 71, and the above-described flexure continues. When the lid reaches the closed position, the hinge is in the position shown in FIG. 4A, with wall 82 engaging segment 71 and segment 77 engaging segment 74, and the lid is maintained in the closed position by the lock mechanism.

The aforedescribed abutment of fold line 80 with the first segment 71 occurs after the lid has been pivoted about 120° from the position shown in FIG. 1 toward the closed position. When the container is placed on a horizontal surface, the weight of the lid is sufficient to provide the lid with a position of static equilibrium at this point.

When in the closed position, the lid 20 is resiliently biased toward the open position by the hinge 22 and sufficient potential energy is stored in the hinge structure 22 to drive the lid from the closed position to the open position upon release of the lock mechanism. The hinge 22 provides sufficient torque to accelerate the lid rapidly from the closed position through the above-described equilibrium position, to a position over 90° displaced from the closed position, at which point gravity determines the resting point of the lid. If the container is at rest on a horizontal surface, the lid will continue to pivot until it comes to rest on the horizontal surface.

One problem which has been encountered in providing a hinge mechanism to bias the lid toward the open position as described hereinabove is that such a hinge mechanism may tend to push the rear of the lid upward, away from the lower portion of the container, which is undesirable.

The hinge structure 22 as described hereinabove provides the desired opening torque and potential energy storage without tending to raise the rear of the lid to an unacceptable degree. One aspect of the hinge which contributes to the avoidance of undesirable elevation of the rear of the lid is the fact that, in the open position, the channel 58 is disposed below the upper surface 36 of the rim 34 which the channel overlies when in the closed position. The deformation of the hinge 22 as described above is controlled by its configuration so that as the lid is pivoted into the fully closed position, the rear end of the lid is maintained at the desired elevation, overlying the rear of the rim 34 and spaced therefrom by a small distance or in contact therewith.

To open the container 10, the user may support the container in one hand, positioned with the palm up, with the thumb engaging the front wall and one or more fingers engaging the back wall. When pressure is applied to squeeze the thumb toward the fingers, deflecting the front wall 26 inward, the bosses 64 at the opposite front corners of the container can clear the edge 40 of the lip 38, and the hinge 22 drives the lid 20 upward toward the open position. The user may then remove a single slice or a desired number of slices with his or her opposite hand, while still holding the container as described above. The ability to release the locks in this manner, combined with the capability of the hinge 22 to open the lid as described above, enables the container to be opened with relatively little effort as compared with the prior art containers described hereinabove.

About ⅛ in. clearance is provided within the container between the front wall 66 and the upper forward edge of the product contained therein. This provides sufficient clearance to enable the locks to be released as described above with little or no deformation of the food product within the container.

The container is preferably formed from a polyester, polyethylene terepthalate (PETE), or another suitable polymeric material capable of storing sufficient potential energy in the hinge structure to effect the desired opening of the lid after the container has been maintained in a closed position for an extended period, e.g., the shelf life of the food product. The material must be one which is not susceptible to relaxation over such a time period of the strain by which the potential energy is stored. While polyethylene terepthalate has been found suitable, other polymers having sufficient crystallinity might also be suitable. The material selected preferably is substantially transparent so that the consumer can view the product inside the container.

The container is preferably formed in a thermoforming or vacuum molding operation, with the lid disposed in an open position displaced 180° from the closed position. In the thermoforming or vacuum molding operation, a plug is employed to drive a portion of a heated sheet of thermoplastic material into a mold cavity and a vacuum in the mold cavity pulls the material off of the plug and causes the material to conform to the interior of the mold cavity. In the thermoforming operation, the thickness of the material of the resulting container typically diminishes toward the lower portions thereof. This enables relatively thin cross sections to be provided along the lines corresponding to the action points 92, 94 described hereinabove.

The closed container as viewed in plan is preferably between 4 and 5 in. square. The height of the container varies according to capacity. A container for a 16 oz. stack of sliced cheese has a height of about 2.5 in. The height of a container for an 8 oz. stack of sliced cheese is about 1.50. The starting gauge of the PETE material used to form the container is preferably between about 0.015 and 0.03 in.

From the foregoing, it will be appreciated that the invention provides a novel and improved container for food products. The invention is not limited to the embodiments described above or to any particular embodiments, and is pointed with particularity in the following claims.

What is claimed is:

1. A polymeric container in combination with a plurality of slices of a food product stacked within the container, said container comprising a bottom wall, a peripheral wall structure extending upward from said bottom wall, a lid comprising a top surface and a rear wall extending downward therefrom, and an integral hinge connection said lid to said peripheral wall structure, said hinge being flexible so that said lid is pivotable through an angle of at least about 90° between a closed position and an open position while remaining connected to said peripheral wall structure by said hinge;

said peripheral wall structure comprising a rear wall, a front wall opposite said rear wall, and a pair of opposite side walls extending between said front and rear walls;

said peripheral wall structure and said lid having surfaces thereon defining a lock mechanism for maintaining said lid in stable mechanical equilibrium in said closed position;

said flexible hinge in its underformed configuration corresponding to the open position of the lid comprising a series of integrally joined generally rectangular segments which are recited in order proceeding from said rear wall of said container to said rear wall of said lid and including a first segment downwardly extending along the rear wall of said container and spaced therefrom, a second segment extending generally horizontally rearward from the lower end of the first segment, third, fourth, and fifth segments respectively, extending upwardly, rearwardly and downwardly respectively, with the third and fifth segments being of approximately equal length; a sixth segment extending rearwardly, and having a horizontal dimension less than that of the second segment; a seventh segment extending upwardly to a fold line at which it intersects the rear wall of the lid to define an inverted U-shaped configuration; the seventh segment having a vertical dimension less than that of the first segment and having its lower edge at approximately the same elevation as the lower edge of the first segment and each of the segments intersecting its adjacent segments at an angle of about 90°;

said first three segments defining a first upwardly opening channel and the fifth, sixth and seventh segments defining a second upwardly opening channel with the third, fourth and fifth segments defining a downwardly opening channel which is disposed between the first two, sharing a common side wall with each;

said segments dimensioned and configured relative to each other and the hinge having lines of weakness at the intersection of both aid second and third segments and said fifth and sixth segments such that when the lid is moved from the open position to the closed position, the initial pivotal motion of the lid causes flexure of the hinge in a first mode, which principally comprises flexure at the lines of intersection between the second and third segments and between the fifth and sixth segments which enables the second channel to close upon itself, such that the seventh segment abuts the intersection between the fourth and fifth segment and so that said first and third segments also move toward one another, and the upper portion of said seventh segment comes into abutting contact with said first segment and such that further displacement of the lid toward the closed position causes said first segment to flex away from the rear wall of the container, and the seventh segment to pivot away from the rear wall of the lid until in its closed position, the rear wall of said lid engages said first segment and said seventh segment engages the fourth segment and the lid is maintained in the closed position by said lock mechanism;

and such that in the closed position, the lid is resiliently biased toward the open position by the hinge and sufficient potential energy is stored in the hinge to drive the lid from the closed position toward the open position upon release of the lock mechanism.

2. A combination in accordance with claim 1 wherein said lock mechanism can be released by manual inward defection of said peripheral wall structure without application of external manual force directly to said lid.

3. A combination in accordance with claim 1, said peripheral wall structure having a substantially horizontal upper rim surface and said lid having a corresponding surface which overlies said rim surface when said lid is in said closed position, wherein said lid has an open position displaced substantially 180° from said closed position in which said corresponding surface of said lid is disposed substantially horizontally at an elevation lower than that of said horizontal upper rim surface.

4. A combination in accordance with claim 1 wherein said hinge is capable of storing sufficient potential energy to pivot said lid from said closed position to said open position upon release of said lock mechanism.

* * * * *

UNITED STATES PATENT AND TRADEMARK OFFICE

CERTIFICATE OF CORRECTION

PATENT NO. : 5,242,696

DATED : September 7, 1993

INVENTOR(S) : John F. McDevitt

It is certified that error appears in the above-identified patent and that said Letters Patent is hereby corrected as shown below:

Column 6, line 27, change "connection" to --connecting--.

Column 6, line 40, change "underformed" to --undeformed--.

Column 7, line 15, change "segment" to --segments--.

Signed and Sealed this

Nineteenth Day of April, 1994

Bruce Lehman

BRUCE LEHMAN

*Commissioner of Patents and Trademarks*

*Attest:*

*Attesting Officer*